US005855767A

United States Patent [19]

Powers et al.

[11] Patent Number: 5,855,767

[45] Date of Patent: Jan. 5, 1999

[54] HYDROREFINING PROCESS FOR PRODUCTION OF BASE OILS

[75] Inventors: John Robert Powers, Port Neches; Gerald Foley Prescott, Bridge City; James Roger Whiteman, Beaumont, all of Tex.

[73] Assignee: Star Enterprise, Houston, Tex.

[21] Appl. No.: 313,528

[22] Filed: Sep. 26, 1994

[51] Int. Cl.[6] ..... C10G 45/00

[52] U.S. Cl. ..... 208/143; 208/27; 208/28; 208/108; 208/111; 208/110; 208/138; 208/142; 208/144

[58] Field of Search ..... 208/143, 27, 78, 208/108, 111, 138, 142, 144

[56] References Cited

U.S. PATENT DOCUMENTS

| | | | |
|---|---|---|---|
| 3,700,585 | 10/1972 | Chen et al. | 208/111 |
| 3,852,189 | 12/1974 | Chen et al. | 208/120 |
| 3,894,938 | 7/1975 | Gorring et al. | 208/97 |
| 3,904,511 | 9/1975 | Heiba et al. | 208/177 |
| 3,956,102 | 5/1976 | Chen et al. | 208/93 |
| 3,960,705 | 6/1976 | Garwood et al. | 208/111 |
| 3,966,586 | 6/1976 | Owen et al. | 208/120 |
| 3,968,024 | 7/1976 | Gorring et al. | 208/111 |
| 3,979,279 | 9/1976 | Yan | 208/264 |
| 4,044,064 | 8/1977 | Milstein et al. | 260/676 |
| 4,053,387 | 10/1977 | Bridger et al. | 208/88 |
| 4,067,797 | 1/1978 | Chen et al. | 208/15 |
| 4,071,574 | 1/1978 | Milstein et al. | 260/676 |
| 4,090,953 | 5/1978 | Bridger et al. | 208/177 |
| 4,124,489 | 11/1978 | Reid | 208/87 |
| 4,137,148 | 1/1979 | Gillespie et al. | 208/87 |
| 4,149,960 | 4/1979 | Garwood et al. | 208/111 |
| 4,153,540 | 5/1979 | Govring et al. | 208/89 |
| 4,176,050 | 11/1979 | Chen et al. | 208/111 |
| 4,181,598 | 1/1980 | Gillespie et al. | 208/58 |
| 4,283,271 | 8/1981 | Garwood et al. | 208/59 |
| 4,283,272 | 8/1981 | Garwood et al. | 208/59 |
| 4,343,692 | 8/1982 | Winquist | 208/111 |
| 4,347,121 | 8/1982 | Mayer et al. | 208/58 |
| 4,414,097 | 11/1983 | Chester et al. | 208/59 |
| 4,597,854 | 7/1986 | Penick | 208/58 |
| 4,699,707 | 10/1987 | Moorehead et al. | 208/57 |
| 4,728,415 | 3/1988 | Unmuth et al. | 208/87 |
| 4,747,932 | 5/1988 | Miller | 208/61 |
| 4,755,279 | 7/1988 | Unmuth et al. | 208/87 |
| 4,790,927 | 12/1988 | Ward et al. | 208/89 |
| 4,859,311 | 8/1989 | Miller | 208/89 |
| 4,869,806 | 9/1989 | Degnan et al. | 208/111 |
| 4,875,992 | 10/1989 | Hamner | 208/89 |
| 4,921,594 | 5/1990 | Miller | 208/58 |
| 4,943,424 | 7/1990 | Miller | 423/328 |
| 4,952,306 | 8/1990 | Sawyer et al. | 208/143 |
| 4,952,396 | 8/1990 | Sayer et al. | 208/143 |
| 5,006,224 | 4/1991 | Smegal et al. | 208/254 |
| 5,030,780 | 7/1991 | Ward et al. | 208/143 |
| 5,087,347 | 2/1992 | Miller | 208/46 |
| 5,112,472 | 5/1992 | Gosselink et al. | 208/59 |
| 5,114,562 | 5/1992 | Haun et al. | 208/89 |
| 5,143,595 | 9/1992 | Thomas et al. | 208/58 |
| 5,147,526 | 9/1992 | Kukes et al. | 208/111 |
| 5,149,421 | 9/1992 | Miller | 208/114 |
| 5,151,172 | 9/1992 | Kukes et al. | 208/144 |
| 5,158,665 | 10/1992 | Miller | 208/46 |
| 5,158,671 | 10/1992 | Cody et al. | 208/264 |
| 5,183,556 | 2/1993 | Reilly et al. | 208/57 |
| 5,183,656 | 2/1993 | Reilly et al. | 208/57 |
| 5,198,099 | 3/1993 | Trachte et al. | 208/89 |
| 5,208,005 | 5/1993 | Miller | 423/702 |
| 5,230,881 | 7/1993 | Miller | 423/705 |
| 5,246,566 | 9/1993 | Miller | 208/27 |
| 5,266,188 | 11/1993 | Kukes et al. | 208/216 R |
| 5,273,645 | 12/1993 | Clark et al. | 208/143 |
| 5,277,794 | 1/1994 | Delaney et al. | 208/143 |
| 5,282,958 | 2/1994 | Gantilli et al. | 208/111 |
| 5,288,395 | 2/1994 | Marier et al. | 208/58 |
| 5,336,394 | 8/1994 | Iino et al. | 208/216 R |
| 5,350,504 | 9/1994 | Dessau | 208/143 |
| 5,364,514 | 11/1994 | Sanborn et al. | 208/58 |
| 5,391,287 | 2/1995 | Nakagawa | 208/143 |
| 5,391,291 | 2/1995 | Winquest et al. | 208/143 |
| 5,407,559 | 4/1995 | Degnan et al. | 208/89 |
| 5,409,596 | 4/1995 | Fletcher et al. | 208/89 |
| 5,413,695 | 5/1995 | Miller | 208/143 |
| 5,435,907 | 7/1995 | Sudhakar et al. | 208/143 |
| 5,456,820 | 10/1995 | Forbus, Jr. et al. | 208/111 |

FOREIGN PATENT DOCUMENTS 1240913 7/1971 United Kingdom .

OTHER PUBLICATIONS

Modern Petroleum Technology, pp. 722–724 Hobson (ed) 1972 (Applied Sci. Publishers).

Steinmetz et al "Process Flexibility of Lube Hydrotreating" API Proceedings, Div. of Ref. (1973).

*Primary Examiner*—Helane Myers

*Attorney, Agent, or Firm*—Wendy K. Buskop; Chamberlain, Hrdlicka et al.

[57] ABSTRACT

A process for saturating aromatics in a lube range hydrocarbon is disclosed. The process can be used to raise the viscosity index of the lube range products. The process is carried out over a noble metal catalyst under mild process conditions. The catalyst is resistant to sulfur and nitrogen compounds.

32 Claims, 1 Drawing Sheet

HYDROREFINING PROCESS FOR PRODUCTION OF BASE OILS

BACKGROUND OF THE INVENTION

The invention relates to hydrotreating and aromatics saturation of lube oil stocks.

Low viscosity motor oils are desirable for better fuel economy. These oils must exhibit a high viscosity index in order to provide best results.

Highly paraffinic stocks have a high viscosity index but an unacceptably high pour point as well. It is necessary to remove the wax components from these stocks in order to provide an acceptably low pour point. Since the wax components contribute to a high viscosity index, their removal reduces the viscosity index of the product. Yield of product is reduced as well. The wax components are most commonly removed by solvent dewaxing. Techniques for obtaining both improvements in yield and in the viscosity index of a product having an acceptably low pour point are much sought after.

One such technique is catalytic dewaxing. In catalytic dewaxing, the high pour point waxy components are converted to lower pour point components, preferably lower pour point components which have a good viscosity index. However, the procedure causes some reduction in yield. Also, aromatic and heteroatom constituents, which are poor contributors to viscosity index, are not converted or removed by this technique.

Hydrotreating can be used for heteroatom removal. The technique is commonly referred to as hydrodesulfurization/hydrodenitrogenation, abbreviated as HDS/HDN. HDS/HDN removes sulfur and/or nitrogen containing species which are poor contributors to viscosity index. However, some loss in yield is experienced.

Aromatics saturation can be used to convert the aromatic species. The aromatic components do not contribute to viscosity index as greatly as do their saturated products and their saturation does not markedly decrease yield.

Several companies have developed technologies which effectively saturate aromatics in lube stocks but all of these processes employ very severe operating conditions including very high pressure (2000–3000 psi), temperature (up to 700°+F.), low space velocities (0.25–1.0 LHSV), and high hydrogen consumption. The catalysts used are deactivated by sulfur and/or nitrogen in the feed. A process which effectively saturates aromatics in lube stocks at mild processing conditions and is capable of accommodating sulfur and nitrogen in the feed would be very desirable.

OBJECTS OF THE INVENTION

It is an object of this invention to provide a process for saturating aromatics in a lube range hydrocarbon at low operating pressure.

It is another object of this invention to provide a process for changing the distribution of aromatic components in a lube range hydrocarbon.

It is a further object of this invention to provide a process for saturating aromatics in a lube range hydrocarbon which is well suited for accommodating significant concentrations of sulfur and/or nitrogen in the feed.

It is another object of this invention to provide processing options for converting lube range hydrocarbons into base oil stocks having a low pour point and a high viscosity index in good yields.

SUMMARY OF THE INVENTION

In one embodiment of the invention, there is provided a process comprising contacting an aromatics saturation reactor feed with an aromatics saturation catalyst to produce a dearomatized oil product. The aromatics saturation catalyst comprises noble metals on a zeolite-containing inorganic oxide support. The process is conducted at a temperature in the range of about 350° F. to about 700° F. and hydrogen at a partial pressure in the range of about 150 psig to 3500 psig. The process is characterized in that the aromatics saturation reactor feed has a viscosity in the range of about 50 SUS to about 600 SUS at 100° F.

In another embodiment of the invention, the aromatics saturation reactor feed is formed by conducting HDS/HDN on an HDS/HDN feed. The effluent from HDS/HDN is passed to the aromatics saturation reactor. Interstage gas separation is optional, since the aromatics saturation catalyst can accommodate significant concentrations of sulfur and nitrogen species under the process conditions employed.

In another embodiment of the invention, the aromatics saturation reactor feed is formed by catalytically dewaxing a catalytic dewaxer feed at a temperature in the range of from about 500° F. to about 800° F. and at a pressure in the range of from about 200 to about 5,000 psig to form the aromatics saturation reactor feed. Preferably, HDS/HDN is conducted either before or after the catalytic dewaxing. Good results may usually be obtained from the aromatics saturation reactor when operated under approximately the same conditions of temperature and pressure as the catalytic dewaxer.

In another embodiment of the invention, the aromatics saturation reactor feed is formed by solvent dewaxing a solvent dewaxer feed using a wax-selective solvent, preferably followed by HDS/HDN for heteroatom removal. Solvent dewaxing produces a lube range hydrocarbon that is rich in aromatic components and lube product properties are markedly improved by hydrogenating at least a portion of these components in the aromatics saturation reactor.

DETAILED DESCRIPTION OF THE PREFERRED EMBODIMENTS

Figure 1:
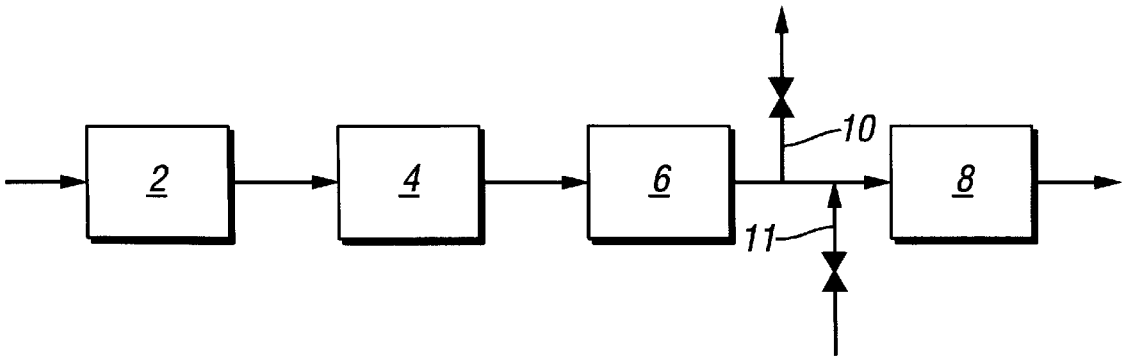
FIG. 1 schematically illustrates a reactor train which can be used to carry out certain embodiments of the invention.

This invention offers a major improvement over the prior art since significant aromatics reduction can be achieved under much less severe and less costly operating conditions than according to the prior art. The inventors were aware that the sulfur and nitrogen components of low to medium viscosity, solvent refined lube stocks could be reduced to very low levels while operating at mild hydrotreating conditions, i.e., 1.0 LHSV, on the order of 600 psi, and temperatures on the order of <650°–700° F. However, catalytic dewaxed oils hydrotreated at similar conditions had not performed as well as expected in engine performance testing. It was felt that the poor engine performance was possibly due to the aromatics content of the base oils. Research began to find an aromatics saturation catalyst to change the aromatics content and/or distribution in lube oil stocks and that was compatible with known lube oil processing techniques and process conditions. The instant invention was conceived and developed.

Two primary applications of the invention are believed to be:

(1) preparation of a lube base stock for multi-grade (e.g., 5W-30) engine oil applications by solvent extraction of lube boiling range distillates, catalytic dewaxing such as with a ZSM-5 based catalyst, high temperature-low pressure hydrotreating with HDS/HDN catalyst for viscosity index increase, and aromatic saturation and associated stability improvement using an aromatics saturation catalyst.

(2) preparation of a lube base stock for multi grade (e.g., 5W-30) engine oil applications by solvent extraction of lube boiling range distillates, mild hydrotreating, optional stripping for hydrogen sulfide and ammonia removal, catalytic dewaxing such as with a SAPO-11 based catalyst followed by aromatics saturation and base oil stability improvement using an aromatics saturation catalyst.

While base oil stocks of high viscosity index are finding increased applications, most of the world base oil production and lubricant formulations are based on stocks exhibiting viscosity indices of 95 or lower. The invention has the direct result of increasing the overall yield of finished base stock and lowering the associated manufacturing costs for a volume of base oil produced.

In this unique improvement, a base oil is manufactured via solvent extraction of lube boiling range distillate, mild hydrotreating for removal of sulfur and nitrogen components, optional stripping, and then Isodewaxing followed by hydroprocessing utilizing an aromatics saturation catalyst for aromatic reduction and stability improvement. It should also be noted that, if maintaining yield or viscosity was not a consideration, that the aromatics saturation catalyst could be used to increase base oil viscosity index (VI).

We are not aware of any prior art which discloses aromatics saturation processing in a lube oil manufacturing process at mild temperature and pressure and can be used to manufacture base oils with desired aromatic component distributions. Since the catalyst can operate without interstage gas separation, i.e., being exposed to off-gases with fairly significant nitrogen and sulfur content, this is an additional advantage.

Figure 2:
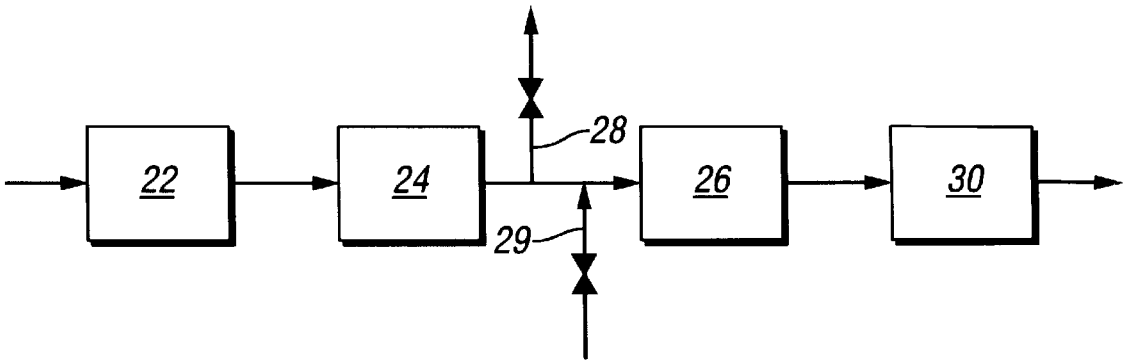
FIG. 2 schematically illustrates another reactor train which can be used to carry out certain embodiments of the invention.

FIGS. 1 and 2 schematically illustrate two lube oil trains in which certain embodiments of the invention could be carried out.

In FIG. 1, the effluent from a solvent extractor 2 forms the feed for a dewaxer 4. A lube boiling range hydrocarbon forms the feed for the solvent extractor 2. The effluent from the dewaxer 4 forms the feed for HDS/HDN unit 6. The effluent from the HDS/HDN unit forms the feed for aromatics saturation reactor 8. If desired, interstage gases can be removed from the aromatics saturation reactor feed via line 10. When this is done it is necessary to add makeup hydrogen upstream of the aromatic saturators by a line 11. The effluent from the aromatics saturation reactor unit 8 can be finished to form a base oil product which can be subsequently blended into finished lubricants as is known in the art.

In FIG. 2, the effluent from a solvent extractor 22 forms the feed for a HDS/HDN unit 24. A lube boiling range hydrocarbon forms the feed for the solvent extractor 22. The effluent from the HDS/HDN unit forms the feed for a dewaxer 26. If desired, interstage gases can be removed from the feed to the dewaxer via line 28. When this is done, it is necessary to add makeup hydrogen upstream of the dewaxer 26 by a line 29. The effluent from the dewaxer 26 forms the feed for aromatics saturation reactor 30. The effluent from the aromatics saturation reactor 30 can be finished to form a base oil product which can be subsequently blended as is known in the art.

The feed to the aromatics saturation reactors 8 and 30 generally has a viscosity in the range of about 50 SUS to about 600 SUS at 100° F. Usually, the feed will have a viscosity in the range of from about 70 SUS to about 250 SUS 100° F. The aromatics content of the feed will generally be in the range of about 20% to about 35% by volume. The aromatics saturation unit will usually be employed to reduce the aromatics content of the feed by at least about 20%, such as on the order of 20% to 50%. The degree of dearomatization which is optimal will depend on the characteristics of the feed. For most lube oil feeds, beneficial results will be obtained when the aromatics content of the product has been reduced to within the range of 3% to 25% by volume. However, decreased solubility of the additive package may result with an aromatics content below about 10%. It is thus preferred that the dearomatized product contain aromatics in an amount in the range of about 10% to about 25% by volume. Suitable feeds for processing in accordance with the invention will generally exhibit a boiling range within the range of 500° F. to 1100° F. The 95% boiling point will usually be in excess of 800° F.

Depending on the process options selected, the feed to the aromatics saturation reactor may have significant concentrations of sulfur and nitrogen as either gaseous or liquid compounds. For example, an aromatics saturation reactor feed having a combined sulfur and nitrogen content, based on elemental analysis, in the range of from about 0.01 to about 3 weight percent may be processed in accordance with certain embodiments of the invention. The sulfur and nitrogen may be in the form of organic molecules or gaseous hydrogen sulfide and ammonia, or both. Usually, the sulfur and nitrogen will be mostly in the form of hydrogen sulfide and ammonia, most often at a combined concentration in the range of 0.05 to about 1 weight percent, based on the total weight of the saturation reactor feed.

Generally speaking, the aromatics saturation reactor is operated at a temperature in the range of about 350° F. to about 700° F., usually in the range of from about 400° F. to about 600° F. and preferably in the range of from about 450° F. to about 550° F. Good results will be provided at low hydrogen partial pressures, but it is advantageous to operate the aromatics saturation reactor at a pressure only slightly lower than the upstream equipment, to provide for flow. Generally speaking, the hydrogen partial pressure will be in the range of about 150 psig to 3500 psig, usually in the range of from about 300 psig to about 2,500 psig and most preferably in the range of from about 300 psig to about 1,200 psig. Low severity contact between the catalyst and feed will provide good results. Generally, an LHSV in the range of from about 0.1 $v_o/Hr/v_c$ to about 10 will be used, usually in the range of from about 1 $v_o/Hr/v_c$ to about 4 $v_o/Hr/v_c$. The hydrogen rate will usually be in the range of from about 500 scf to about 10,000 scf of hydrogen with each barrel of the aromatics saturation reactor feed. Usually in the range of from about 1,000 scf to about 4,000 scf of hydrogen are contacted with the aromatics saturation catalyst with each barrel of the aromatics saturation reactor feed. Hydrogen purity can vary over a wide range but will generally be 80% pure or higher.

Generally the aromatics saturation catalyst comprises oxides of platinum and palladium supported on an alumina matrix. To provide selectivity for aromatic molecules, the matrix usually contains dispersed zeolite which has a pore size for preferentially reacting aromatic molecules. Generally, only small amounts of platinum and palladium are used. The aromatics saturation catalyst will generally contain in the range of from about 0.1 wt % to about 1 wt % platinum and in the range of from about 0.1 wt % to about 1 wt % palladium, based on elemental weight of metal.

It is believed that the use of a Y-type zeolites in the aromatics saturation catalysts will provide best results, especially Y-type zeolites having relatively low alkali metal contents, say less than 0.3, preferably less than about 0.15 percent by weight basis metal and which have been ion exchanged to increase their alkali(ne earth) metal content. "Y-type zeolites" are zeolites which have the same general crystal structure as zeolite Y but which have contracted unit cells when compared to zeolite Y. These zeolites having contracted unit cells are also known as ultrastable or ultra-stabilized Y zeolites.

The zeolitic materials which can be used as starting materials to form the aromatics saturation catalysts comprise readily available Y-type zeolites such as zeolite Y, ultrastable zeolite Y and very ultra-stable zeolite Y which have been modified by using processes known in the art to produce the base materials having the required unit cell size dimension together with the required silica to alumina molar ratios and low alkali(ne earth) metal content. Such modification of unit cell size and silica to alumina molar ratio also necessarily produce zeolites having low alkali(ne earth) metal contents. Suitable modification processes comprise ion-exchange techniques, say one or more ion-exchange steps with ammonium compounds, followed by one or more calcination stages, optionally in the presence of steam. Normally, Y-type zeolites already partially modified are subjected to a so-called dealumination technique to reduce the amount of alumina present in the system.

The starting zeolite for the production of the aromatics saturation catalyst preferably comprises a Y-type zeolite having a unit cell size less than 24.65 angstroms, a silica to alumina molar ratio of greater than 5 and an alkali(ne earth) metal content of less than 0.3 percent by weight basis metal. Preferably, the unit cell size of the starting zeolite should be less than 24.4 angstroms, preferably less than 24.35 angstroms and more preferably less than 24.30 angstroms. More preferably the unit cell size will range between 24.2 and 24.3 angstroms, and most preferably between 24.22 and 24.28 angstroms. The silica to alumina molar ratio of the preferred zeolite should be greater than 25, more preferably greater than 35, even more preferably greater than 50, and most preferably greater than 60. The processes used to dealuminate zeolites to obtain the high silica to alumina molar ratios of the starting zeolites result in zeolites having alkali(ne earth) metal contents that are relatively low compared to zeolite Y. The alkali(ne earth) metal contents of the preferred starting zeolites are less than 0.15, preferably less than 0.075 and more preferably less than 0.04 percent by weight of the zeolite basis the alkali(ne earth) metal.

The starting zeolites are contacted with one or more solutions, preferably aqueous solutions, comprising one or more alkali(ne earth) metal ions. The contact of the zeolite with the solution of alkali(ne earth) metal ions encompasses ion exchange, impregnation and mixtures thereof. The zeolite is contacted with the solution of alkali(ne earth) metal ions under conditions of temperature and times sufficient to cause an increase of alkali(ne earth) metal in the final or processed zeolite of greater than 1.5 times, preferably 2 times, more preferably greater than 5 times the amount of alkali(ne earth) metal originally present in the starting zeolite, when measured as gram equivalent weights of alkali(ne earth) metal per gram of zeolite. For example, if the starting zeolite contained 0.05 percent by weight of sodium oxide, then contact with a sodium ion-containing solution to provide a sodium content greater than 1.5 times would require an increase to greater than 0.075 weight percent sodium oxide, greater than 2 times would require an increase to greater than 0.1 weight percent of sodium oxide, etc. Solution contact temperatures will typically range from 10° C. to 100° C. Times will generally be in excess of 0.1 hours. The processed zeolite will have an alkali(ne earth) metal content ranging from about 0.00004 to about 0.0004 gram equivalent weights of metal per gram of zeolite. In a preferred embodiment wherein the alkali(ne earth) metal is sodium, potassium or mixtures thereof, the processed zeolite will have an alkali metal content ranging from 0.1 to 1.4 percent by weight, basis metal, more preferably from 0.1 to 0.8 weight percent, basis metal, for sodium, from 0.2 to 1.4 weight percent, basis metal, for potassium; and 0.1 to 1.4 weight percent, basis metal, for the mixture.

Preferably, the zeolite is admixed with a binder material, such as alumina, silica, silica-alumina aluminophosphates, silicoaluminophosphates, magnesia, titania, clays or zirconia and mixtures thereof, more preferably alumina.

Preferably, the feed for the aromatics saturation reactor unit 8 or 30 is the effluent from an HDS/HDN unit 6 or a dewaxer 26. Preferably, the entire effluent from the upstream unit is charged to the aromatics saturation reactor unit, without interstage gas separation or stripping, but where the upstream unit is an HDS/HDN unit, interstage gas separation and possibly stripping such as with hydrogen may be preferred, depending on the hydrogen sulfide and ammonia content of the effluent.

The HDS/HDN units 6 and 24 will generally operate under the same conditions, albeit on different feeds, and will be described together. Generally speaking, the HDS/HDN is conducted at a temperature in the range of from about 575° F. to about 750° F. Usually, the temperature will be in the range of from about 600° F. to about 725° F. Preferably, the temperature will be in the range of about 625° F. to about 700° F. Hydrogen will generally be present at a hydrogen partial pressure in the range of from about 150 psig to about 3500 psig, and total pressure will generally be in the range of from about 200 psig to about 4,000 psig. Usually, hydrogen partial pressure will be in the range of from about 350 psig to about 1400 psig and a total pressure will be in the range of from about 400 psig to about 1500 psig.

Generally, in the range of from about 1,000 scf to about 10,000 scf of hydrogen are contacted with the HDS/HDN catalyst with each barrel of the HDS/HDN feed. Usually, from about 3,000 scf to about 8,000 scf of hydrogen are contacted with the HDS/HDN catalyst with each barrel of the HDS/HDN feed. Severity of contact can vary over a wide range, depending on the degree of heteroatom removal sought. Generally, the HDS/HDN is conducted at an LHSV in the range of from about 0.25 $v_o/Hr/v_c$ to about 2.5 $v_o/Hr/v_c$. Usually, an LHSV in the range of 0.75 $v_o/Hr/v_c$ to about 1.5 $v_o/Hr/v_c$, is employed.

A catalyst having HDS/HDN activity under these conditions is placed in the unit. Generally, a non-noble-metal-containing HDS/HDN catalyst is used. Suitable HDS/HDN catalysts generally comprise alumina or silica alumina and carry Group VIII and/or Group VIB metals as the catalytically active agent. Most preferably, the catalytically active HDS/HDN agent is selected from the group consisting of nickel/molybdenum, cobalt/molybdenum and nickel/tungsten.

A finished catalyst for utilization in the HDS/HDN zone preferably has a surface area of about 200 to 700 square meters per gram, a pore diameter of about 20 to about 300 Angstroms, a pore volume of about 0.10 to about 0.80 milliliters per gram, and apparent bulk density within the range of from about 0.50 to about 1.00 gram/cc. Surface areas above 250 $m^2$/gm are greatly preferred.

An alumina component suitable for use as a support for the HDS/HDN catalyst may be produced from any of the various hydrous aluminum oxides or alumina gels such as alpha-alumina monohydrate of the boehmite structure, alpha-alumina trihydrate of the gibbsite structure, beta-alumina trihydrate of the bayerite structure, and the like. A particularly preferred alumina is referred to as Ziegler alumina. A preferred alumina is presently available from the Conoco Chemical Division of Continental Oil Company under the trademark "Catapal". The material is an extremely high purity alpha-alumina monohydrate (boehmite) which, after calcination at a high temperature, has been shown to yield a high purity gamma-alumina.

A silica-alumina component may be produced by any of the numerous techniques which are well defined in the prior art relating thereto. Such techniques include the acid-treating of a natural clay or sand, co-precipitation or successive precipitation from hydrosols. These techniques are frequently coupled with one or more activating treatments including hot oil aging, steaming, drying, oxidizing, reducing, calcining, etc. The pore structure of the support or carrier, commonly defined in terms of surface area, pore diameter and pore volume, may be developed to specified limits by any suitable means including aging a hydrosol and/or hydrogel under controlled acidic or basic conditions at ambient or elevated temperature, or by gelling the carrier at a critical Ph or by treating the carrier with various inorganic or organic reagents.

The precise physical characteristics of the catalysts such as size, shape and surface area are not considered to be a limiting factor in the utilization of the present invention. The catalyst particles may be prepared by any known method in the art including the well-known oil drop and extrusion methods. The catalysts may, for example, exist in the form of pills, pellets, granules, broken fragments, spheres, or various special shapes such as trilobal extrudates, disposed as a fixed bed within a reaction zone. Alternatively, the catalysts may be prepared in a suitable form for use in moving bed reaction zones in which the hydrocarbon charge stock and catalyst are passed either in countercurrent flow or in co-current flow. Another alternative is the use of fluidized or ebullated bed reactors in which the charge stock is passed upward through a turbulent bed of finely divided catalyst, or a suspension-type reaction zone, in which the catalyst is slurried in the charge stock and the resulting mixture is conveyed into the reaction zone. The charge stock may be passed through the reactors in either upward or downward flow.

Although the hydrogenation components may be added to the HDS/HDN catalyst before or during the forming of the support, the hydrogenation components are preferably composited with the catalysts by impregnation after the selected inorganic oxide support materials have been formed, dried and calcined. Impregnation of the metal hydrogenation component into the particles may be carried out in any manner known in the art including evaporative, dip and vacuum impregnation techniques. In general, the dried and calcined particles are contacted with one or more solutions which contain the desired hydrogenation components in dissolved form. After a suitable contact time, the composite particles are dried and calcined to produce finished catalyst particles.

Hydrogenation components contemplated for the HDS/HDN catalysts are those catalytically active components selected from Group VIB and Group VIII metals and their compounds. References herein to the Periodic Table are to that form of the table printed adjacent to the inside front cover of Chemical Engineer's Handbook, edited by R. H. Perry, 4th edition, published by McGraw-Hill, copyright 1963. Generally, the amount of hydrogenation components present in the final catalyst composition is small compared to the quantity of the other above-mentioned components combined therewith. The Group VIII component generally comprises about 0.1 to about 30% by weight, preferably about 1 to about 15% by weight of the final catalytic composite calculated on an elemental basis. The Group VIB component comprises about 0.05 to about 30% by weight, preferably about 0.5 to about 15% by weight of the final catalytic composite calculated on an elemental basis. The hydrogenation components contemplated for the HDS/HDN catalyst include one or more metals chosen from the group consisting of molybdenum, tungsten, chromium, iron, cobalt, nickel, platinum, palladium, iridium, osmium, rhodium, ruthenium and mixtures thereof. The desulfurization catalyst preferably contains two metals chosen from cobalt, nickel, tungsten and molybdenum.

The hydrogenation components of the HDS/HDN catalyst will most likely be present in the oxide form after calcination in air and may be converted to the sulfide form if desired by contact at elevated temperatures with a reducing atmosphere comprising hydrogen sulfide, a mercaptan or other sulfur containing compound.

It is preferred that the catalyst(s) used in the HDS/HDN zone is essentially free of any noble metal such as platinum or palladium. It is also preferred that the aromatics saturation zone is essentially free of non-noble metal catalysts.

In another embodiment of the invention, the feed for the aromatics saturation reactor can be prepared using a dewaxer. Solvent dewaxing and catalytic dewaxing are both suitable. The feed is preferably subjected to HDS/HDN either before or after dewaxing. Solvent dewaxing will be described first. The description is applicable to unit 26 as well as 4 when operating to carry out solvent dewaxing.

In solvent dewaxing a solvent dewaxer feed is dewaxed using a wax-selective solvent to form the feed for the next downstream unit. A wide variety of wax selective solvents may be used. Preferably, the solvent is selected from the group consisting of methylethylketone/toluene, methylisobutylketone, methylisobutylketone/methylethylketone, dichloroethylene/methylenechloride, and propane, because solvent dewaxing using these solvents is known. Generally speaking, solvent dewaxing is carried out at a solvent/oil ratio in the range of from about 0.5 to about 10 and at a temperature in the range of between about −50° F. and about 40° F. Usually, the solvent dewaxing is carried out at a solvent/oil ratio in the range of from about 2 to about 5 and at a temperature in the range of between about −20° F. and about 10° F.

In catalytic dewaxing, the feed is passed over a dewaxing catalyst under dewaxing conditions to form the feed for the next subsequent downstream unit. Generally speaking, suitable dewaxing conditions include a temperature in the range of from about 500° F. to about 800° F. and a pressure in the range of from about 200 to about 5,000 psig.

Two general types of catalytic dewaxing processes are believed to be suitable, cracking and isomerization. These processes are exemplified by the ZSM-5 based catalyst, which relies heavily on a cracking mechanism to dewax the stock, and the SAPO-11 based catalyst or equivalent, which relies heavily on an isomerization mechanism to dewax the stock.

In the first case, the catalytic dewaxing catalyst comprises a zeolite selected from the group consisting of ZSM 5 and ZSM 35 on an alumina support. The catalytic dewaxing is usually conducted at an LHSV in the range of from about 0.5 vol/vol/hr to about 2.5 $v_o/Hr/v_c$. Usually, hydrogen is present at a partial pressure in the range of from about 150 psig to about 3,500 psig, preferably in the range of from about 350 psig to about 1,400 psig. Generally, from about 1,000 scf to about 10,000 scf of hydrogen are contacted with the catalytic dewaxing catalyst with each barrel of the catalytic dewaxer feed. Usually from about 3,000 to about 8,000 scf of hydrogen are contacted with the catalytic dewaxing catalyst with each barrel of the catalytic dewaxer feed.

In the second case, the catalytic dewaxing catalyst comprises a zeolite support having deposited thereon a catalytic agent selected from the group consisting of nickel, nickel/tungsten, platinum and palladium. The catalytic dewaxing is generally conducted at a temperature in the range of from about 400° F. to about 800° F., usually in the range of from about 575° F. to about 750° F., and preferably at a temperature in the range of from about 600° F. to about 750° F. Usually, hydrogen is present at a partial pressure in the range of from about 150 psig to about 3,500 psig, preferably in the range of from about 350 psig to about 1,400 psig. The catalytic dewaxing is generally conducted at an LHSV in the range of from about 0.1 $v_o Hr/v_c$ to about 10 $v_o/Hr/v_c$, usually in the range of about 0.2 $v_o/Hr/v_c$ to about 8 $v_o/Hr/v_c$, and preferably is conducted at an LHSV in the range of from about 0.5 $v_o/Hr/v_c$ to about 2 $v_o/Hr/v_c$. Generally, from about 1,000 scf to about 10,000 scf of hydrogen are contacted with the catalytic dewaxing catalyst with each barrel of the catalytic dewaxer feed. Usually from about 2,000 to about 5,000 scf of hydrogen are contacted with the catalytic dewaxing catalyst with each barrel of the catalytic dewaxer feed. When the dewaxing catalyst contains noble metals, it is preferred that the catalytic dewaxer feed contain low levels of sulfur and nitrogen.

The preferred zeolite support to be used in the second case comprises a silicoaluminophosphate molecular sieve (SAPO). The preferred SAPO comprises a molecular sieve having a silicoaluminophosphate molecular framework which has an intermediate pore size and which comprises a molecular framework of cornersharing $[SiO_2]$ tetrahedra, $[AlO_2]$ tetrahedra, and $[PO_2]$ tetrahedra, [i.e., $(SiAl_yP)O_2$ tetrahedral units], and which functions to convert the feedstock to dewaxed products under the process conditions noted above.

By "intermediate pore size" is meant an effective pore aperture in the range of about 5.3 to 6.5 Angstroms when the molecular sieve is in the calcined form. Molecular sieves having pore apertures in this range tend to have unique molecular sieving characteristics. Unlike small pore zeolites such as erionite and chabazite, they will allow hydrocarbons having some branching into the molecular sieve void spaces. Unlike larger pore zeolites such as the faujasites and mordenites, they can differentiate between n-alkanes and slightly branched alkanes on the one hand and larger branched alkanes having, for example, quaternary carbon atoms.

The silicoaluminophosphates are generally synthesized by hydrothermal crystallization from a reaction mixture comprising reactive sources of silicon, aluminum and phosphorus, and one or more organic templating agents. Optionally, alkali metal(s) may be present in the reaction mixture. The reaction mixture is placed in a sealed pressure vessel, preferably lined with an inert plastic material, such as polytetrafluoroethylene, and heated, preferably under autogenous pressure at a temperature of at least 100° C., and preferably between 100° C. and 250° C., until crystals of the silicoaluminophosphate product are obtained, usually for a period of from 2 hours to 2 weeks. While not essential to the synthesis of SAPO compositions, it has been found that in general stirring or other moderate agitation of the reaction mixture and/or seeding the reaction mixture with seed crystals of either the SAPO to be produced , or a topologically similar composition, facilitates the crystallization procedure. The product is recovered by any convenient method such as centrifugation or filtration.

The reaction mixture from which these SAPOs are formed contain one or more organic templating agents (templates). The template preferably contains one element of Group VA of the Periodic Table, particularly nitrogen, phosphorus, arsenic and/or antimony, more preferably nitrogen or phosphorus and most preferably nitrogen. The template contains at least one alkyl, aryl, aralkyl, or alkylaryl group. The template preferably contains from 1 to 8 carbon atoms, although more than eight carbon atoms may be present in the template. Nitrogen-containing templates are preferred, including amines and quaternary ammonium compounds, the latter being represented generally by the formula $R'_4N+$ wherein each R' is an alkyl, aryl, allylaryl, or other aralkyl group; wherein R' preferably contains from 1 to 8 carbon atoms or higher when R' is alkyl and greater than 6 carbon atoms when R' is otherwise, as hereinbefore discussed. Polymeric quaternary ammonium salts such as $[(C_{14}H_{32}N_2)(OH)_2]_x$ wherein "x" has a value of at least 2 may also be employed. The mono-, di- and triamines, including mixed amines, may also be employed as templates either alone or in combination with a quaternary ammonium compound or other template.

Solvent extractors 2 and 22 prepare the feed for their respective downstream units. In the solvent extractors, a crude oil derived stream having an initial boiling point generally in the range of from about 500° F. to about 650° F. and a 95% boiling point generally in the range of 800° F. to 950° F. is extracted with a known solvent to form the feed for the next adjacent downstream unit. Suitable solvents are well known, as are process conditions. Common suitable solvents include N-methyl-pyrrolidone, furfural, phenol and sulfur dioxide. The raffinate from the extraction forms the feed for the next downstream unit.

The invention is illustrated by the following examples.

EXAMPLE 1

Table 1 shows use of an aromatics saturation catalyst to conduct aromatics saturation of Feedstock A in a manner to simulate a process using interstage gas separation.

TABLE 1

| | Operating Mode | | | |
|---|---|---|---|---|
| Nominal Pilot Unit Operating Conditions | Off-Line | Off-Line | Off-Line | Feed |
| Temperature, F. | 499 | 550 | 599 | |
| Pressure, psig | 580 | 579 | 579 | |
| LHSV | 1.89 | 3.0 | 4.99 | |
| Hydrogen Rate, SCFB Feed | 3232 | 3234 | 3001 | |
| Hydrogen Consumption, SCFB | 80 | 102 | 102 | |
| Lube Yield, wt %[1] | 98.94 | 98.53 | 98.21 | |
| Test Results | | | | |
| Viscosity, cSt @ 40° C. | 58.98 | 57.61 | 55.47 | 59.12 |
| , cSt @ 100° C. | 7.77 | 7.69 | 7.55 | 7.83 |
| , SUS @ 100° F. | 305 | 298 | 287 | 306 |

TABLE 1-continued

| Nominal Pilot Unit Operating Conditions | Operating Mode Off-Line | Off-Line | Off-Line | Feed |
|---|---|---|---|---|
| Viscosity Index | 95 | 96 | 97 | 96 |
| Pour, F. | 10 | 12 | 12 | 10 |
| Compositional Analysis by MS | | | | |
| Total Saturates, vol % | 73.4 | 76.8 | 76.3 | 68.7 |
| Total Aromatics, vol % | 26.6 | 23.2 | 23.7 | 31.3 |
| Monoaromatics, vol % | 12.3 | 12.8 | 10.0 | 18.6 |
| Unidentified Aromatics, vol % | 8.0 | 5.7 | 7.6 | 4.7 |

[1]Basis feedstock IBP.

EXAMPLE 2

Table 2 shows use of an aromatics saturation catalyst to conduct aromatics saturation of Feed A in a manner to simulate cascading the entire effluent from the upstream reactors without interstage gas separation.

TABLE 2

| Nominal Pilot Unit Operating Conditions | Feed | Feed[2] | Operating Mode In-Series |
|---|---|---|---|
| Temperature, F. | | | 574 |
| Pressure, psig | | | 589 |
| LHSV | | | 2.04 |
| Hydrogen Rate, SCFB Feed | | | 3278 |
| Hydrogen Consumption, SCFB | | | 249 |
| Lube Yield, wt %[1] | | | 75.36[a] |
| Test Results | | | |
| Viscosity, cSt @ 40° C. | 53.7 | 59.12 | 59.28 |
| , cSt @ 100° C. | 7.77 | 7.83 | 7.81 |
| , SUS @ 100° F. | 277 | 306 | 307 |
| Viscosity Index | 110 | 96 | 95 |
| Pour, F. | 110 | 10 | 10 |
| Compositional Analysis by MS | | | |
| Total Saturates, vol % | 66.3 | 68.7 | 70.2 |
| Total Aromatics, vol % | 33.7 | 31.3 | 29.8 |
| Monoaromatics, vol % | 19.5 | 18.6 | 22.7 |
| Unidentified Aromatics, vol % | 2.8 | 4.7 | 1.1 |

[1]Basis feedstock IBP.
[2]Feed to the aromatics saturation catalyst when used in-series is assumed to be essentially equivalent to the catalytically dewaxed, hydrofinished material.
[a]Lube yield is typical of that obtained for catalytically dewaxed, hydrofinished base oils. As indicated by the yields of 98 + wt % in Table I, the aromatics saturation catalyst does not reduce lube yield significantly.

EXAMPLE 3

Table 3 shows use of an aromatics saturation catalyst to conduct aromatics saturation of Feedstock B in a manner which simulates a process using interstage gas separation.

TABLE 3

| Nominal Pilot Unit Operating Conditions | Operating Mode Off-Line | | | Feed[2] |
|---|---|---|---|---|
| Temperature, F. | 552 | 552 | 503 | |
| Pressure, psig | 580 | 578 | 528 | |
| LHSV | 1.97 | 3.06 | 1.95 | |
| Hydrogen Rate, SCFB Feed | 3420 | 3222 | 1391 | |
| Hydrogen Purity, vol % | 100 | 100 | 100 | |
| Hydrogen Consumption, SCFB | 337 | 330 | 229 | |
| Lube Yield, wt %[1] | 99.27 | 99.26 | 98.06 | |

TABLE 3-continued

| Nominal Pilot Unit Operating Conditions | Operating Mode Off-Line | | | Feed[2] |
|---|---|---|---|---|
| Viscosity, cSt @ 40° C. | 16.41 | 16.40 | 16.40 | 16.58 |
| , cSt @ 100° C. | 3.62 | 3.61 | 3.61 | 3.61 |
| , SUS @ 100° F. | 89 | 89 | 89 | 89 |
| Viscosity Index | 102 | 101 | 101 | 98 |
| Pour, F. | 10 | 10 | 15 | 5 |
| Compositional Analysis by MS | | | | |
| Total Saturates, vol % | 95.7 | 93.9 | 89.8 | 76.7 |
| Total Aromatics, vol % | 4.3 | 6.1 | 10.2 | 23.3 |
| Monoaromatics, vol % | 1.8 | 2.7 | 8.4 | 11.0 |
| Unidentified Aromatics, vol % | 1.0 | 1.5 | 0.4 | 5.2 |
| Predictive Model Data | | | | |
| Average Engine Sludge | 9.53 | 9.50 | 9.34 | 9.49 |
| Average Engine Varnish | 5.80 | 6.05 | 6.18 | 4.93[a] |

[1]Basis feedstock IBP.
[2]Feedstock used was a catalytically dewaxed, hydrofinished SNO-100 base oil.
[a]Data for SNO-100 base oil from Mid East crude source. Rating of 10 is considered clean so the higher the value the better. Rating of 4.63–4.76 is typical for engine varnish.

EXAMPLE 4

Table 4 shows use of the aromatics saturation catalyst to conduct aromatics saturation of Feedstock B under conditions which simulate conveying the entire effluent from the upstream unit into the aromatics saturation unit.

Table 4

| Nominal Pilot Unit Operating Conditions | Operating Mode In-Series |
|---|---|
| Temperature, F. | 550 |
| Pressure, psig | 591 |
| LHSV | 2.03 |
| Hydrogen Rate, SCFB Feed | 3685 |
| Hydrogen Purity, vol % | 100 |
| Hydrogen Consumption, SCFB | 537 |
| Lube Yield, wt %[1] | 70.20[a] |

| Test Results | RWD-5 Feed | CD HF Feed[2] | Aromat. Sat. Product |
|---|---|---|---|
| Viscosity, cSt @ 40° C. | 16.9 | 16.58 | 17.54 |
| , cSt @ 100° C. | 3.78 | 3.61 | 3.74 |
| , SUS @ 100° F. | 90 | 89 | 94 |
| Viscosity Index | 114 | 98 | 99 |
| Pour, F. | 82 | 5 | 10 |
| Compositional Analysis by MS | | | |
| Total Saturates, vol % | 75.2 | 76.7 | 81.0 |
| Total Aromatics, vol % | 24.8 | 23.3 | 19.0 |
| Monoaromatics, vol % | 17.5 | 11.0 | 15.9 |
| Unidentified Aromatics, vol % | 1.3 | 5.2 | 0.5 |
| Predictive Model Data | | | |
| Average Engine Sludge | — | 9.49 | 9.52 |
| Average Engine Varnish | — | 4.93[b] | 6.08 |

[1]Basis feedstock IBP.
[2]Feed to the aromatics saturation catalyst when used in-series is assumed to be essentially equivalent to the off-line catalytically dewaxed, hydrofinished material.
[a]Lube yield is typical of that obtained for catalytically dewaxed, hydrofinished base oils. As indicated by Table 3, yields of 98 + wt %, the aromatics saturation catalyst does not reduce lube yield significantly.
[b]Data for SNO-100 base oil from Mid East crude source. Rating of 10 is considered clean so the higher the value the better. A typical range of values for oils of this type is 4.63–4.76.

What is claimed is:

1. A process comprising contacting a dewaxed aromatics saturation reactor feed having a combined sulfur and nitrogen content of about 5 ppm and a boiling range within the range of 500° F. to 1100° F. and a viscosity in the range of about 50 SUS to about 600 SUS and an aromatics content in the range of about 20% to about 35% by volume with an aromatics saturation catalyst comprising noble metals on an inorganic oxide support at a temperature in the range of about 350° F. to about 700° F. and hydrogen at a partial pressure in the range of about 150 psig to 3500 psig to produce a dewaxed, dearomatized oil product having a significantly lower aromatics content than the dewaxed aromatics saturation reactor feed.

2. A process as in claim 1 wherein the dewaxed aromatics saturation reactor feed contains ammonia and hydrogen sulfide and has a viscosity in the range of from about 70 SUS to about 250 SUS at 100EF and wherein said aromatics saturation catalyst can accommodate significant concentrations of sulphur and nitrogen species.

3. A process as in claim 1 wherein the dewaxed aromatics saturation reactor feed has a 95% boiling point being in excess of 800° F.

4. A process as in claim 1 wherein the aromatics saturation catalyst comprises oxides of platinum and palladium supported on an alumina matrix having dispersed therein a zeolite, wherein the zeolite has a pore size for preferentially reacting aromatic molecules, the dewaxed aromatics saturation reactor feed has been previously subjected to hydrodesulfurization/hydrodenitrogenation and dewaxed for n-paraffin removal, and the contacting of the aromatics saturation reactor feed and the aromatics saturation catalyst is conducted so that the aromatics content of the dewaxed aromatics saturation reactor feed is reduced between about 20% and about 60%.

5. A process as in claim 1 wherein the aromatics saturation catalyst consists essentially of platinum and palladium supported on an alumina matrix having dispersed therein a zeolite and contains in the range of from about 0.1 wt % to about 1 wt % platinum and in the range of from about 0.1 wt % to about 1 wt % palladium, based on elemental weight of metal and the dewaxed aromatics saturation reactor feed contains in the range of from about 0.1% to about 2% combined weight of ammonia and hydrogen sulfide.

6. A process as in claim 1 wherein the reactor temperature is in the range of from about 400° F. to about 600° F., said process further comprising contacting the aromatics saturation catalyst and the aromatics saturation reactor feed at an LHSV in the range of from about 0.1 $v_o/Hr/v_c$ to about 10 $v_o/Hr/v_c$.

7. A process as in claim 6 wherein the temperature is in the range of from about 450° F. to about 550° F. and the LHSV is in the range of from about 1 $v_o/Hr/v_c$ to about 4 $v_o/Hr/v_c$.

8. A process as in claim 1 wherein the hydrogen partial pressure is in the range of from about 300 psig to about 2,500 psig, said process further comprising contacting the aromatics saturation catalyst with about 500 scf to about 10,000 scf of hydrogen with each barrel of the aromatics saturation reactor feed.

9. A process as in claim 8 wherein the hydrogen partial pressure is in the range of from about 300 psig to about 1,200 psig and in the range of from about 1,000 scf to about 4,000 scf of hydrogen are contacted with the aromatics saturation catalyst with each barrel of the aromatics saturation reactor feed.

10. A process comprising conducting hydrodesulfurization/hydrodenitrogenation on a dewaxed hydrodesulfurization/hydrodenitrogenation feed to form a dewaxed aromatics saturation reactor feed having a combined sulfur and nitrogen content of about 5 ppm and a boiling range within the range of 500° F. to 1100° F. and a viscosity in the range of about 50 SUS to about 600 SUS at 100° F.; and contacting the dewaxed aromatics saturation reactor feed with an aromatics saturation catalyst comprising noble metals on an inorganic oxide support at a temperature in the range of about 350° F. to about 700° F. and hydrogen at a partial pressure in the range of about 150 psig to 3500 psig to produce a dewaxed, dearomatized oil product having a significantly lower aromatics content than the dewaxed aromatics saturation reactor feed.

11. A process as in claim 10 wherein the hydrodesulfurization/hydrodenitrogenation is conducted at a temperature in the range of from about 575° F. to about 750° F. and at a hydrogen partial pressure in the range of from about 150 psig to about 3500 psig in presence of non-noble-metal-containing hydrodesulfurization/hydrodenitrogenation catalyst.

12. A process as in claim 11 wherein the hydrodesulfurization/hydrodenitrogenation is conducted at an LHSV in the range of from about 0.25 $v_o/Hr/v_c$ to about 2.5 $v_o/Hr/v_c$.at a total pressure in the range of from about 200 psig to about 4,000 psig and in the range of from about 1,000 scf to about 10,000 scf of hydrogen are contacted with the hydrodesulfurization/hydrodenitrogenation catalyst with each barrel of the hydrodesulfurization/hydrodenitrogenation feed.

13. A process as in claim 10 wherein the hydrodesulfurization/hydrodenitrogenation catalyst comprises alumina or silica alumina having supported thereon at least one hydrodesulfurization/hydrodenitrogenation agent selected from the group consisting of Group VIII and Group VIB metals and the hydrodesulfurization/hydrodenitrogenation is conducted at a temperature in the range of from about 600° F. to about 725° F., and wherein the aromatics saturation catalyst consists essentially of oxides of platinum and palladium supported on an alumina matrix having dispersed therein a zeolite and the total effluent from hydrodesulfurization/hydrodenitrogenation is contacted with the aromatics saturation catalyst.

14. A process as in claim 13 wherein the hydrodesulfurization/hydrodenitrogenation agent is selected from the group consisting of nickel/molybdenum, cobalt/molybdenum and nickel/tungsten and the hydrodesulfurization/hydrodenitrogenation is conducted at a hydrogen partial pressure in the range of from about 350 psig to about 1400 psig, a total pressure in the range of from about 400 psig to about 1500 psig, a temperature in the range of about 625° F. to about 700° F., an LHSV in the range of 0.75 $v_o/Hr/v_c$ to about 1.5 $v_o/Hr/v_c$, and from about 3,000 scf to about 8,000 scf of hydrogen are contacted with the catalyst with each barrel of the hydrodesulfurization/hydrodenitrogenation feed.

15. A process as in claim 10 further comprising forming the hydrodesulfurization/hydrodenitrogenation feed by using a wax-selective solvent to solvent dewax a solvent dewaxer feed.

16. A process as in claim 15 wherein the wax selective solvent is selected from the group consisting of methylethylketone/toluene, methylisobutylketone, methylisobutylketone/methylethylketone, dichloroethylene/methylenechloride, and propane, said process further comprising solvent refining a crude oil derived stream having an initial boiling point in the range of from about 500° F. to about 700° F. and a 95% boiling point in the range of 800° F. to 950° F. with a lube-stock-extracting solvent to form the solvent dewaxer.

17. A process as in claim 10 further comprising catalytically dewaxing a catalytic dewaxer feed at a temperature in the range of from about 500° F. to about 800° F. and at a pressure in the range of from about 200 psig to about 5,000 psig to form the hydrodesulfurization/hydrodenitrogenation.

18. A process as in claim 17 further comprising solvent refining a crude oil derived stream having an initial boiling point in the range of from about 500° F. to about 700° F. and a 95% boiling point in the range of 800° F. to 950° F. with a lube-oil-extracting solvent to form the catalytic dewaxer feed.

19. A process comprising catalytically dewaxing a catalytic dewaxer feed at a temperature in the range of from about 500° F. to about 800° F. and at a pressure in the range of from about 200 to about 5,000 psig to form a dewaxed aromatics saturation reactor feed, said dewaxed aromatics saturation reactor feed having a combined sulfur and nitrogen content of about 5 ppm and a boiling range within the range of 500° F. to 1100° F. and a viscosity in the range of about 50 SUS to about 600 SUS at 100° F.; and contacting the dewaxed aromatics saturation reactor feed with an aromatics saturation catalyst comprising noble metals on an inorganic oxide support at a temperature in the range of about 350° F. to about 700° F. and hydrogen at a partial pressure in the range of about 150 psig to 3500 psig to produce a dewaxed, dearomatized oil product, wherein the dewaxed aromatics saturation reactor feed has an aromatics content in the range of about 20% to about 35% by volume and the dewaxed, dearomatized oil product has a significantly lower aromatics content than the dewaxed aromatics saturation reactor feed.

20. A process as in claim 19 wherein the catalytic dewaxing is conducted in the presence of a catalytic dewaxing catalyst at an LHSV in the range of from about 0.5 $v_o/Hr/v_c$ to about 2.5 $v_o/Hr/v_c$, a hydrogen partial pressure in the range of from about 150 psig to about 3,500 psig, from about 1,000 scf to about 10,000 scf of hydrogen are contacted with the catalytic dewaxing catalyst with each barrel of the catalytic dewaxer feed, and the total effluent from catalytic dewaxing is contacted with the aromatics saturation catalyst.

21. A process as in claim 20 wherein the catalytic dewaxing catalyst comprises a zeolite selected from the group consisting of ZSM 5 and ZSM 35 on an alumina support, and the catalytic dewaxing is conducted at a total pressure in the range of from about 400 psig to about 1,500 psig, a hydrogen partial pressure in the range of from about 350 psig to about 1,400 psig, and from about 3,000 to about 8,000 scf of hydrogen are contacted with the catalytic dewaxing catalyst with each barrel of the catalytic dewaxer feed.

22. A process comprising catalytically dewaxing a catalytic dewaxer feed in the presence of a catalytic dewaxing catalyst at a temperature in the range of from about 500° F. to about 800° F. and at a pressure in the range of from about 200 to about 5,000 psig to form a dewaxed aromatics saturation reactor feed having a combined sulfur and nitrogen content of about 5 ppm and a boiling range within the range of 500° F. to 1100° F. and a viscosity in the range of about 50 SUS to about 600 SUS at 100° F.; and contacting the dewaxed aromatics saturation reactor feed with an aromatics saturation catalyst comprising noble metals on an inorganic oxide support at a temperature in the range of about 350° F. to about 700° F. and hydrogen at a partial pressure in the range of about 150 psig to 3500 psig to produce a dearomatized oil product having a significantly lower aromatics content than the dewaxed aromatics saturation reactor feed, wherein the catalytic dewaxing catalyst comprises a zeolite-containing support having deposited thereon a catalytic agent selected from the group consisting of nickel, nickel/tungsten, platinum and palladium and the catalytic dewaxing is conducted at an LHSV in the range of from about 0.5 $v_o/Hr/v_c$ to about 2 $v_o/Hr/v_c$ and from about 3,000 scf to about 8,000 scf of hydrogen are contacted with the catalytic dewaxing catalyst with each barrel of the catalytic dewaxer feed.

23. A process as in claim 19 wherein the catalytic dewaxing is conducted at an LHSV in the range of from about 0.1 $v_o/Hr/v_c$ to about 10 $v_o/Hr/v_c$, from about 1,000 scf to about 10,000 scf of hydrogen are contacted with the catalytic dewaxing catalyst with each barrel of the catalytic dewaxer feed and the total effluent from catalytic dewaxing is contacted with the aromatics saturation catalyst.

24. A process as in claim 23 wherein the catalytic dewaxing is conducted at a total pressure in the range of from about 200 psig to about 5,000 psig, and from about 2,000 scf to about 5,000 scf of hydrogen are contacted with the catalytic dewaxing catalyst with each barrel of the catalytic dewaxer feed.

25. A process as in claim 24 wherein the catalytic dewaxing catalyst comprises a zeolite-containing inorganic oxide support and the catalytic dewaxing is conducted at a temperature in the range of from about 600° F. to about 750° F. at an LHSV in the range of from about 0.5 $v_o/Hr/v_c$ to about 2 $v_o/Hr/v_c$ and from about 2,000 to about 5,000 scf of hydrogen are contacted with the catalytic dewaxing catalyst with each barrel of the catalytic dewaxer feed.

26. A process as in claim 19 further comprising conducting hydrodesulfurization/hydrodenitrogenation on an hydrodesulfurization/hydrodenitrogenation feed at a temperature in the range of from about 575° F. to about 750° F. and at a hydrogen partial pressure in the range of from about 150 psig to about 3500 psig to form the catalytic dewaxer feed.

27. A process as in claim 26 further comprising solvent refining a crude oil derived stream having an initial boiling point in the range of from about 500° F. to about 650° F. and a 95% boiling point in the range of 800° F. to 950° F. with a lube-oil-extracting solvent to form the hydrodesulfurization/hydrodenitrogenation feed.

28. A process comprising solvent dewaxing a solvent dewaxer feed using a wax-selective solvent to form a dewaxed aromatics saturation reactor feed having a combined sulfur and nitrogen content of about 5 ppm and a boiling range within the range of 500° F. to 1100° F. and a viscosity in the range of about 50 SUS to about 600 SUS at 100° F.; and contacting the dewaxed aromatics saturation reactor feed with an aromatics saturation catalyst comprising noble metals on an inorganic oxide support, at a temperature in the range of about 350° F. to about 700° F., and hydrogen at a partial pressure in the range of about 150 psig to 3500 psig to produce a dewaxed, dearomatized oil product having a significantly lower aromatics content than the dewaxed aromatics saturation reactor feed.

29. A process as in claim 28 wherein the wax selective solvent is selected from the group consisting of methylethylketone/toluene, methylisobutylketone, methylisobutylketone/methylethylketone, dichloroethylene/methylenechloride, and propane and the solvent dewaxing is carried out at a solvent/oil ratio in the range of from about 0.5 to about 10 and at a temperature in the range of between about −50° F. and about 40° F.

30. A process as in claim 29 wherein the solvent dewaxing is carried out at a solvent/oil ratio in the range of from about 2 to about 5 and at a temperature in the range of between about −20° F. and about 10° F.

31. A process as in claim 28 further comprising conducting hydrodesulfurization/hydrodenitrogenation on an hydrodesulfurization/hydrodenitrogenation feed at a temperature in the range of from about 575° F. to about 750° F. and at a hydrogen partial pressure in the range of from about 150 to about 3500 psig to form the solvent dewaxer feed.

32. A process as in claim 31 further comprising solvent refining a crude oil derived stream having an initial boiling point in the range of from about 500° F. to about 700° F. F and a 95% boiling point in the range of 800° F. to 950° F. with a lube-oil-extracting solvent to form the hydrodesulfurization/hydrodenitrogenation feed.

* * * * *